United States Patent [19]

Heisterberg

[11] 3,944,113

[45] Mar. 16, 1976

[54] FLOATING ROOF

[75] Inventor: Milton W. Heisterberg, Flossmoor, Ill.

[73] Assignee: General American Transportation Corporation, Chicago, Ill.

[22] Filed: Nov. 18, 1974

[21] Appl. No.: 524,575

[52] U.S. Cl. ..... 220/219
[51] Int. Cl.[2] ..... B65D 87/18
[58] Field of Search ..... 220/216–227

[56] References Cited

UNITED STATES PATENTS

| | | | |
|---|---|---|---|
| 1,493,091 | 5/1924 | Wiggins | 220/218 |
| 1,819,401 | 8/1931 | Bailey | 220/218 |
| 2,287,213 | 6/1942 | Wiggins | 220/216 |
| 2,321,058 | 6/1943 | Wiggins | 220/219 |
| 2,386,022 | 10/1945 | Wiggins | 220/219 |
| 2,664,220 | 12/1953 | Cord et al. | 220/219 |
| 2,750,067 | 6/1956 | Wiggins | 220/219 |
| 3,474,931 | 10/1969 | Daniels et al. | 220/219 |
| 3,647,113 | 3/1972 | Belleli | 220/219 |
| R23,417 | 10/1951 | Praeger et al. | 220/219 |

*Primary Examiner*—William Price
*Assistant Examiner*—Stephen Marcus
*Attorney, Agent, or Firm*—Prangley, Dithmar, Vogel, Sandler & Stotland

[57] ABSTRACT

A floating roof for floating upon and covering liquids stored in storage tanks, the roof including a deck generally conforming to the shape of the associated storage tank and having transverse dimensions and a thickness such that the deck is flexible, a pontoon around the outer periphery of the deck to impart buoyancy thereto, and a hermetically sealed hollow floatation ring mounted on the deck intermediate the center and the outer edge thereof, the weight of the floatation ring being asymmetrically disposed so as to place an area of the deck at a lower level than all other areas to provide a sump, and a drain communicating with the sump to drain liquid from the upper surface of the deck.

17 Claims, 10 Drawing Figures

FLOATING ROOF

BACKGROUND OF THE INVENTION

The present invention relates generally to improvements in floating roofs, and particularly to a floating roof for covering and protecting petroleum and petrochemical liquids stored in storage tanks.

Floating roofs in use heretofore are of the pontoon type and consist of a single thickness of steel plate shaped to provide a liquid-tight membrane covering the surface of the liquid being stored and carrying on the outer edge thereof a pontoon that imparts buoyancy to the deck and the floating roof. The pontoon is of hollow construction and further includes bulkhead plates therein dividing the pontoon into a plurality of liquid-tight compartments. Examples of typical prior floating roofs are shown in U.S. Pat. No. 2,386,022 granted to John H. Wiggins, and U.S. Pat. No. 3,724,704 granted to Norman W. Edwards, et al.

Such structures are economical and structurally adequate for roofs having relatively small diameters. As the roof diameter increases, the structural requirements imposed upon the pontoon due to the weight of the deck in the event of a water load or leakage becomes uneconomical. Additionally, as the size of the deck portion of the floating roof increases, drainage of rain water therefrom becomes virtually impossible because of deck flexibility and built-in constructional buckles and water collecting pockets.

SUMMARY OF THE INVENTION

The present invention provides a floating roof for covering liquids stored in storage tanks or the like that facilitates drainage of water and leakage therefrom while maintaining the buoyancy thereof, the invention permitting an essentially unlimited diameter of the floating roof.

This is accomplished in the present invention, and it is an object of the present invention to accomplish these desired results, by providing a floating roof wherein the roof includes a deck generally conforming to the horizontal cross-sectional shape of the associated storage tank and having transverse dimensions and a thickness such as to cause the deck to be flexible, a pontoon for the deck imparting buoyancy thereto to float the roof upon the surface of the stored liquid, the deck having an upper surface and a lower surface in contact with the stored liquid to prevent evaporation therefrom and to prevent contamination thereof, and means on the deck deforming the deck to place an area thereof at a lower level than all the other areas thereof so as to provide a sump thereon, and a drain communicating with the sump to drain liquid from the upper surface of the deck to maintain the buoyancy of the roof at all times.

Another object of the invention is to provide a floating roof of the type set forth wherein a hermetically sealed hollow floatation ring is mounted on the deck and is secured thereto intermediate the center and the outer edge thereof, the weight of the floatation ring being asymmetrically disposed with respect to the deck so as to place an area of the deck at a lower level than all other areas of the deck to provide a sump thereon.

Yet another object of the invention is to provide a floating roof of the type set forth wherein the asymmetric distribution of weight of the floatation ring results from the fact that the floatation ring is formed of a pair of spaced-apart side walls extending upwardly from the deck a predetermined uniform height with a cover plate having a uniform thickness covering the areas between the side walls, the side walls having uniform thicknesses around the floatation ring but being spaced closer to each other at one point therearound and being spaced farthest apart from each other at another point therearound disposed from the one point, thereby to provide greater weight per unit area of the floatation ring at the one point to place the corresponding area of the deck at a lower level than all other areas of the deck to provide a sump thereon.

Still another object of the invention is to provide a floating roof of the type set forth wherein the asymmetric distribution of weight of the floatation ring results from the fact that the floatation ring includes a pair of spaced-apart side walls extending upwardly from the deck a predetermined uniform height and a covering plate having a uniform thickness covering the area between the side walls, the side walls being substantially uniformly spaced apart around the floatation ring and being of greatest thickness at one point therearound and decreasing in thickness to a minimum thickness at one point therearound disposed from the one point, thereby to provide greater weight per unit area of the floatation ring at the one point to place the corresponding area of the deck at a lower level than all other areas of the deck to provide a sump thereon.

Yet another object of the invention is to provide a floating roof of the type set forth wherein the asymmetric disposition of the weight of the floatation ring is provided by the fact that the floatation ring includes a pair of spaced-apart side walls of uniform thickness extending upwardly from the deck and a cover plate having a uniform thickness covering the area between the side walls, the side walls being of greatest height at one point therearound and decreasing in height to a minimum height at another point therearound disposed from the one point, thereby to provide greater weight per unit area of the floatation ring at the one point to place the area of the deck at a lower level than all other areas of the deck to provide a sump thereon.

Still another object of the invention is to provide a floating roof of the type set forth wherein two or more floatation rings are provided essentially concentric with each other, the number of floatation rings provided being proportional to the diameter of the floating roof.

A further object of the invention is to provide a floating roof of the type set forth, wherein the floatation rings are formed as a plurality of straight or rectilinear segments interconnected to form a polygonal figuration.

Further features of the invention pertain to the particular arrangement of the parts of the floating roof, whereby the above outlined and additional operating features thereof are attained.

The invention, both as to its organization and method of operation, together with further features and advantages thereof will best be understood with reference to the following specification taken in connection with the accompanying drawings.

DESCRIPTION OF THE PREFERRED EMBODIMENTS

Figure 1:
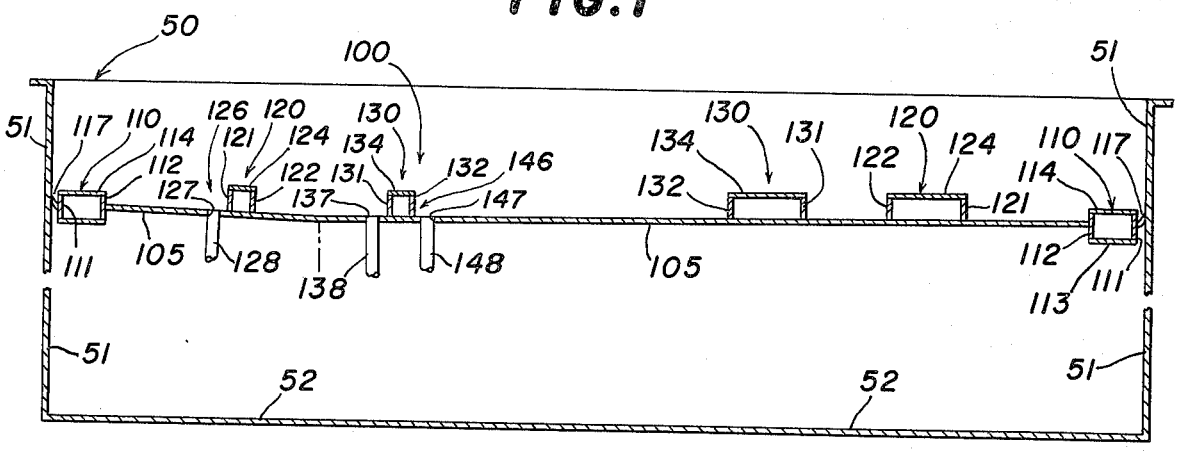
FIG. 1 is a view in vertical section, with certain parts broken away, of a storage tank having therein a first preferred embodiment of a floating roof made in accordance with and embodying the principles of the present invention.
Figure 2:
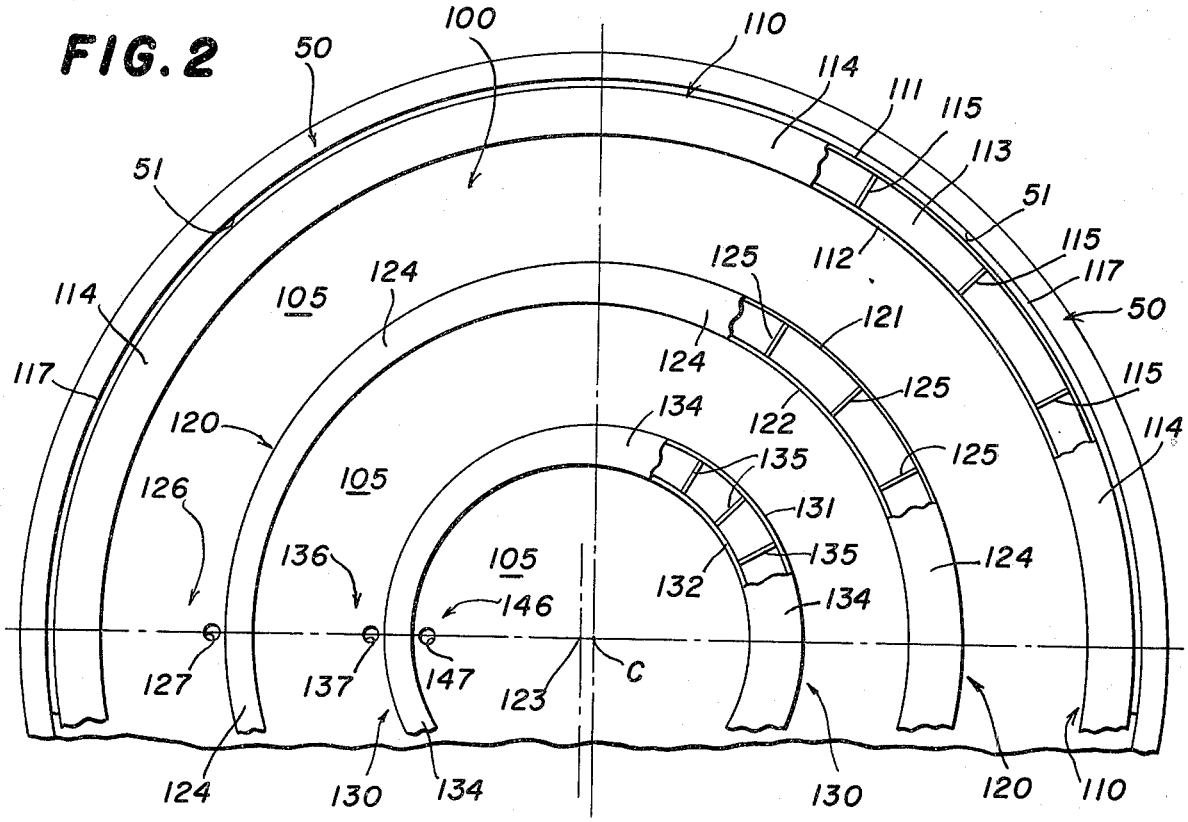
FIG. 2 is a fragmentary plan view of the storage tank of FIG. 1 with certain portions broken away.
Figure 3:
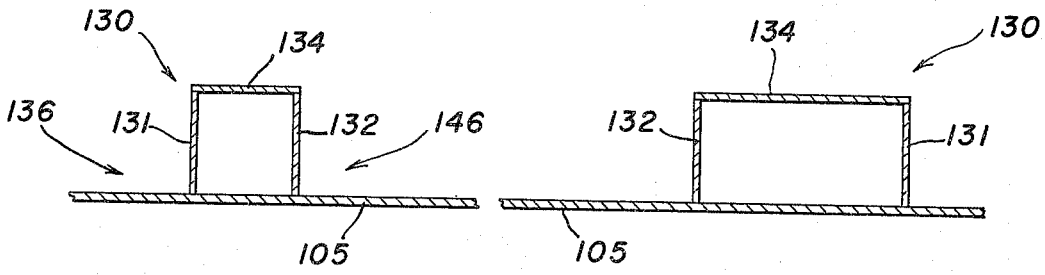
FIG. 3 is an enlarged view in vertical section through the innermost floatation ring of the floating roof of FIGS. 1 and 2 and diagrammatically illustrating the principle of operation thereof.

Referring to FIGS. 1 to 3 of the drawings, there is illustrated a storage tank 50 of the floating roof type having disposed therein a floating roof 100 made in accordance with and embodying the principles of the present invention. The storage tank 50 is particularly adapted for storing liquids such as petroleum products and petrochemical liquids that have a significant vapor pressure, the floating roof 100 being provided to trap and hold the vapors from the petroleum products to prevent escape thereof from the storage tank 50, and also to prevent contamination of the petroleum products by material falling onto the storage tank 50. The storage tank 50 includes an upstanding substantially cylindrical side wall or shell 51 that is in turn mounted upon a suitable base or floor 52. The tank 50 also includes suitable inlet fixtures and outlet fixtures (not shown) for adding lading to the storage tank 50 and for withdrawing lading therefrom.

The floating roof 100 includes a deck 105 which is a sheet of steel plate that substantially covers the surface of the liquid lading stored within the tank 50. Surrounding the deck 105 is a hollow pontoon 110 which extends outwardly from the deck 105 toward the side wall 51, the space therebetween being sealed by sealing structure 117 which may be of the type illustrated and described in U.S. Pat. No. 3,439,829, granted Apr. 22, 1969 to Joseph C. Thompson and Milton W. Heisterberg, the disclosure of which is incorporated herein by reference. The pontoon 110 is constructed of vertical rims or side walls 111 and 112 which are disposed essentially parallel to each other and are circular in shape and concentric with respect to each other, the bottom of the space between the side walls 111 and 112, being closed by a bottom plate 113 and the top being closed by a top or cover plate 114. The joints between the several parts 111, 112, 113, and 114 are sealed and fluid-tight, whereby to render the pontoon 110 floating in character. In addition, a plurality of radially extending and equiangularly spaced-apart bulkhead plates 115 is provided transversely of the pontoon 110 and around the entire length thereof to divide the pontoon 110 into smaller liquid-tight compartments to maintain buoyancy in the event of accidental puncture of the pontoon 110 and to isolate flooding caused by such accidental puncture.

In accordance with the present invention, two floatation rings 120 and 130 are also provided on the deck 105, the floatation rings 120 and 130 being intermediate the center of the deck 105 and the pontoon 110, the floatation ring 120 more specifically being essentially concentric with and intermediate the pontoon 110 and the floatation ring 130, while the floatation ring 130 is essentially concentric with the floatation ring 120. The floatation rings 120 and 130 in cooperation with a drainage system to be described hereafter assure positive drainage of the deck 105, reduce the structural load on the pontoon 110, support the weight of the deck 105 in the event of a puncture or leakage thereof or of the pontoon 110, and greatly reduces the areas affected by a leak in the deck 105, all as will be described more fully hereinafter.

As illustrated, the floatation ring 120 includes an outer side wall or rim 121 that is disposed essentially vertical with respect to the deck 105 and is circular in shape as viewed in FIG. 2 and is essentially concentric with the pontoon 110. An inner side wall or rim 122 is provided that also is disposed essentially vertical with respect to the deck 105 and is circular in shape as viewed in FIG. 2, but is disposed eccentrically with respect to the outer side wall 121, the center thereof being shifted to the left to the point 123 with respect to the center C of the pontoon 110 and the outer side wall 121. It will be appreciated that the deck 105 serves as the bottom plate for the floatation ring 120. A top plate or cover plate 124 is provided, the shape of the cover plate 124 in plan being such as to cover the area between the side walls 121 and 122, all as is illustrated in FIG. 2. A plurality of transverse radially extending bulkhead plates 125 is provided in the floatation ring 120 at spaced points therearound to provide hermetically sealed liquid-tight compartments therein. More specifically, the deck 105, the side walls 121 and 122, the cover plate 124 and the bulkhead plates 125 are all suitably joined one to the other as required, such as by welding or the like, to provide liquidtight seams therebetween.

The floatation ring 130 includes an outer side wall or rim 131 that is disposed essentially vertical with respect to the deck 105, is circular in shape as viewed in FIG. 2, and is essentially concentric with the pontoon 110 and the outer side wall 121 of the floatation ring 120. An inner side wall or rim 132 is provided that also is disposed essentially vertical with respect to the deck 105 and is circular in shape as viewed in FIG. 2, but is disposed essentially with respect to the outer side wall 131, the center thereof being shifted to the left to point 123 with respect to the center C of the pontoon 110 and the outer side wall 131. It will be appreciated that the deck 105 serves as the bottom plate for the floatation ring 130. A top plate or cover plate 134 is provided, the shape of the cover plate 134 in plan being such as to cover the area between the side walls 131 and 132, all as is illustrated in FIG. 2. A plurality of radially extending transverse bulkhead plates 135 is provided in the floatation ring 130 at spaced points therearound to provide hermetically sealed and liquid-tight compartments. More specifically, the deck 105, side walls 131 and 132, the cover plate 134 and the bulkhead plates 135 are all suitably joined one to the other as required, such as by welding or the like, to provide liquid-tight seams therebetween.

The floatation rings 120 and 130 are symmetrical only about the horizontal line through the center point C and are asymmetrical with respect to any other line through point C. Because of the asymmetrical structure of the floatation rings 120 and 130, the deck 105 is deformed downwardly in the areas 126, 136 and 146 to provide sumps thereat, the sump 126 collecting all liquid upon the deck 105 between the pontoon 110 and the floatation ring 120, the sump 136 collecting all liquid upon the deck 105 between the floatation rings 120 and 130, and the sump 146 collecting all liquid upon the deck 105 within the floatation ring 130. Disposed in each of the sumps 126, 136 and 146 is a drain opening 127, 137 and 147, respectively, connected with a drain pipe 128, 138, 148, respectively, that forms part of a drain system to drain liquids to the exterior of the associated tank 50.

The manner in which the deck 105 is deformed downwardly to provide the sumps 126, 136 and 146 can best be understood by reference to diagrammatical FIG. 3 where there is illustrated a cross section through the floatation ring 130 along the horizontal line through the center C in FIG. 2.

The side walls 131 and 132 are illustrated as being of uniform height throughout the length thereof and of uniform thickness, and also are formed of homogeneous material. The cover plate 134 is illustrated as being of uniform thickness throughout the length thereof and is also formed of homogeneous material. With this configuration, the weight supported by a unit area of the deck 105 under the left hand portion of the floatation ring 130 in FIG. 3, is substantially greater than the weight supported by a like unit area of the deck 105 under the portion of the floatation ring 130 to the right in FIG. 3. Since the deck 105 is supported by the stored liquid, and further since the material of construction of the deck 105 is flexible, the submergence at the sumps 126 and 136 is greater than that adjacent to the portions of the floatation ring 130 disposed to the right in FIG. 3.

As a result, water, accumulating due to rain fall for example, will flow in the area of the deck 105 bounded by the floatation ring 130 to the sump 146. Likewise such water will flow from the entire area disposed between the floatation rings 120 and 130 to the sump 136. In a like manner all of the water falling upon the portion of the deck disposed between the pontoon 110 and the floatation ring 120 will flow to the sump 126.

If the deck 105 is punctured, the floatation rings 120 and 130 will support the deck since the rings under those conditions will impart additional buoyancy to the deck 105. More specifically, the water-tight character of the floatation rings 120 and 130 will come into action and will support the deck 105 and all the attached structures by floatation upon the liquid lading within the associated tank 50. The provision of the bulkhead plates 125 and 135 in the floatation rings 120 and 130, respectively, also assures that there will be added buoyancy even if the puncture in the deck 105 occurs in an area covered by one of the floatation rings 120 and 130, the bulkhead plates 125 and 135 isolating and limiting the volume of the floatation rings that would be flooded by the liquid lading.

It will be appreciated that because of the construction of the floatation rings 120 and 130, they also can be added to existing pontoon roofs to improve the drainage and buoyancy thereof.

From the above description, it will be appreciated that the improved floating roof 100 of the present invention assures positive drainage of the deck 105 by providing the sumps 126, 136 and 146 thereon due to the asymmetric distribution of the weight of the floatation rings 120 and 130 upon the deck 105. The structural load on the pontoon 110 is also reduced, the floatation rings 120 and 130 acting to support and reinforce the deck 105; in this connection, the floatation rings 120 and 130 also inhibit wind induced wave motion in the deck 105, thus to reduce the strain thereon and on the pontoon 110. In the event of a leakage due to a puncture of the deck 105, the floatation rings 120 and 130 greatly reduce the area affected by the leak, and also impart added buoyancy to the floating roof 100 to insure continued floatation thereof.

Although two floatation rings 120 and 130 have been illustrated in FIGS. 1 to 3 of the drawings, only one floatation ring 120 may be utilized on floating roofs 100 of smaller diameter, whereas three or more floatation rings may be utilized on floating roofs 100 having greater diameters. The two concentric floatation rings 120 and 130 would be useful upon a floating roof 100 having a radius of the order of 120 feet, i.e., a distance from the center C to the inner surface of the tank side wall 51 of 120 feet. In such a floating roof 100, the pontoon 110 would have a radial width of 10 feet, whereby the deck 105 would have a radius of 110 feet. The outer side wall 121 of the floatation ring 120 has a radius of 70 feet and the outer side wall 131 of the floatation ring 130 has a radius of 30 feet. The height of each of the side walls 121, 122, 131 and 132 is 3 feet. The smallest distance within the side wall 121 and 122 is 3 feet and the greatest distance therebetween is 6 feet, while the smallest distance between the side walls 131 and 132 of the floatation ring 130 is 3 feet and the greatest distance therebetween is 6 feet.

Figure 4:
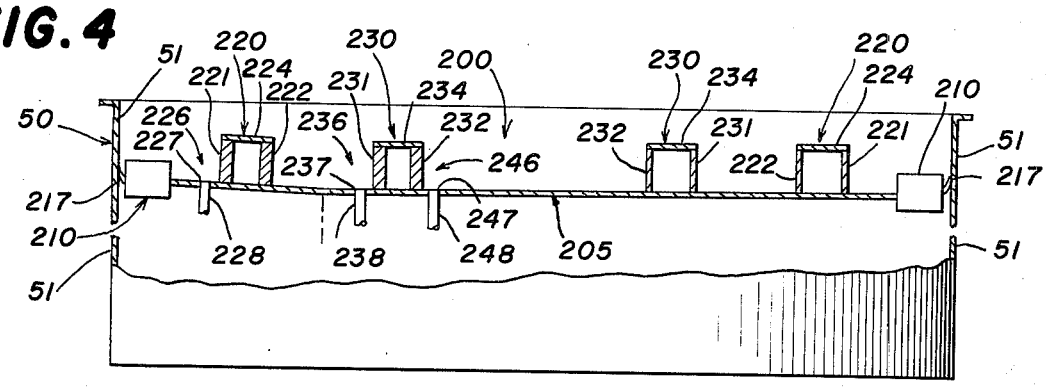
FIG. 4 is a view similar to FIG. 1 illustrating a second preferred embodiment of a floating roof made in accordance with and embodying the principles of the present invention.
Figure 5:
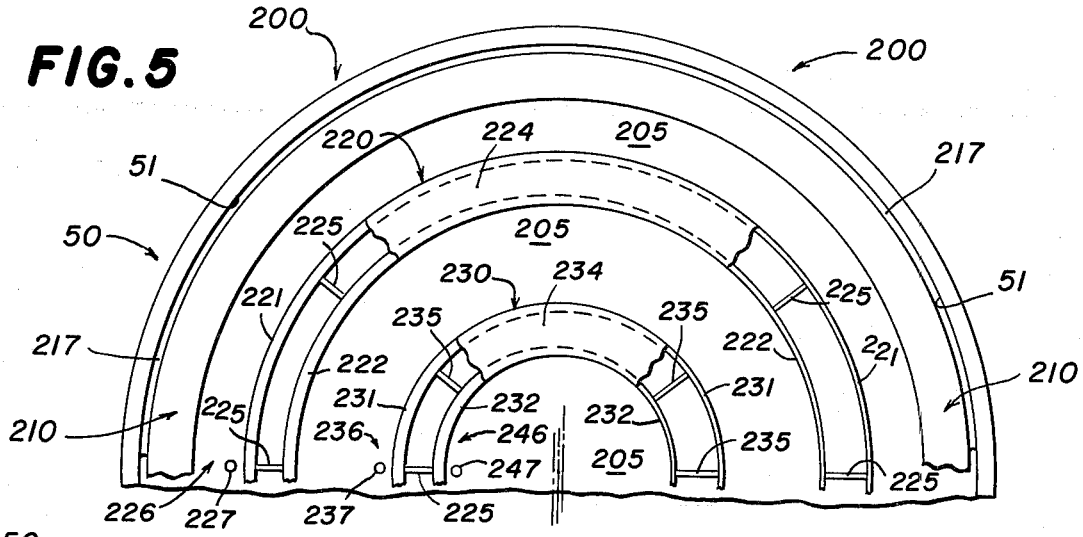
FIG. 5 is a fragmentary plan view of the storage tank of FIG. 4, with certain parts broken away.

Referring to FIGS. 4 and 5 of the drawings, there is shown a second preferred embodiment of a floating roof 200 made in accordance with and embodying the principles of the present invention. Many of the parts of the floating roof 200 are identical in construction to and function like parts in the floating roof 100, whereby suitable numerals in the 200 series corresponding to numerals in the 100 series have been applied to the parts of the floating roof 200 that correspond to like numbered parts in the floating roof 100. The floating roof 200 also has been shown in association with a storage tank 50 identical to that illustrated with respect to the floating roof 100.

The floating roof 200 includes a deck 205 which is a sheet of steel plate that substantially covers the surface of the liquid stored within the tank 50. Surrounding the deck 205 is a pontoon 210 that extends outwardly from the deck 205 toward the side wall 51, the space therebetween being sealed by sealing structure 217 identical to the sealing structure 117 described above. The pontoon 210 has a construction like the pontoon 110 described with respect to the floating roof 100.

Two floatation rings 220 and 230 are provided on the deck 205, the floatation rings 220 and 230 being intermediate the center of the deck 205 and the pontoon 210, the floatation ring 220 being essentially concentric with and intermediate the pontoon 210 and the floatation ring 230, while the floatation ring 230 is essentially concentric with the floatation ring 220.

The floatation ring 220 includes an outer side wall or rim 221 that is disposed essentially vertical with respect to the deck 205, is circular in shape as viewed in FIG. 5, and is essentially concentric with the pontoon 210. An inner side wall or rim 222 is provided that also is disposed essentially vertical with respect to the deck 205, is circular in shape as viewed in FIG. 5, and is disposed essentially concentric with the outer side wall 221. The deck 205 serves as the bottom plate for the floatation ring 220, and a top plate or cover plate 224 is provided, the shape of the cover plate 224 being such as to cover the area between the side walls 221 and 222, all as is illustrated in FIG. 5. A plurality of radially extending transverse bulkhead plates 225 is provided in the floatation ring 220 at spaced points therearound to provide hermetically sealed liquid-tight compartments therein. More specifically, the deck 205, the side walls 221 and 222, the cover plate 224 and the bulkhead plates 225 are all suitably joined one to the other as required, such as by welding or the like, to provide liquid-tight seams therebetween.

The floatation ring 230 includes an outer side wall or rim 231 that is disposed essentially vertical with respect to the deck 205, is circular in shape as viewed in FIG. 5, and is essentially concentric with the pontoon 210 and the outer side wall 221 of the floatation ring 220. An inner side wall or rim 232 is provided that also is disposed essentially vertical with respect to the deck 205, is circular in shape as viewed in FIG. 5, and is essentially concentric with the pontoon 210 and the outer side wall 231. The deck 205 serves as the bottom plate for the floatation ring 230, and a top plate or cover plate 234 is provided, the shape of the cover plate 234 in plan being such as to cover the area between the side walls 231 and 232, all as is illustrated in FIG. 5. A plurality of radially extending transverse bulkhead plates 235 is provided hermetically sealed and liquid-tight compartments. More specifically, the deck 205, the side walls 231 and 232, the cover plate 234 and the bulkhead plates 235 are all suitably joined one to the other as required, such as by welding or the like, to provide liquid-tight seams therebetween.

The side walls 221 and 222 of the floatation ring 220 and the side walls 231 and 232 of the floatation ring 230 are all essentially circular in configuration, concentric one with the other, and of uniform height with respect to the deck 205. The side walls, however, are of varying thickness around the circumference thereof, the thickest points of each of the side walls 221, 222, 231 and 232 being along the horizontal center line to the left in FIG. 5 and at the point of the cross section of FIG. 4 at the left thereof. From the thickest point illustrated at the left in FIG. 4, the side walls 221, 222, 231 and 232 uniformly decrease in thickness to a point along the horizontal center line to the right in FIG. 5 and at which the cross section of FIG. 4 is taken, and specifically the right hand portion thereof.

As a result of this formation of the side walls 221, 222, 231 and 232, the floatation rings 220 and 230 are substantially heavier on the left portions thereof as viewed in FIGS. 4 and 5 than in the right portions thereof. The resultant asymmetrical distribution of weight upon the deck 205 causes the deck 205 to be deformed downwardly in the left hand portions of FIGS. 4 and 5 to provide sumps 226, 236 and 246, the sump 226 collecting all of the liquid upon the deck 205 between the pontoon 210 and the floatation ring 220, the sump 236 collecting all of the liquid upon the deck 205 between the floatation rings 220 and 230, and the sump 246 collecting all of the liquid upon the deck 205 within the floatation ring 230. Disposed in the sumps 226, 236 and 246 are drain openings 227, 237 and 247, respectively, connected with drain pipes 228, 238 and 248, respectively, that form part of a drain system to drain liquids to the exterior of the associated tank 50.

The floatation rings 220 and 230 also perform the important function of providing additional buoyancy to the deck 205 in the event of inadvertent or accidental puncture thereof. More specifically, the water-tight character of the floatation rings 220 and 230 will come into action and will support the deck 205 and all the attached structures by floatation upon the liquid lading within the associated tank 50. The provision of the bulkhead plates 225 and 235 in the floatation rings 220 and 230, respectively, also assures that there will be added buoyancy even if the puncture of the deck 205 occurs in an area covered by one of the floatation rings 220 and 230, the bulkhead plates 225 and 235 isolating and limiting the volume of the floatation rings that would be flooded by the liquid lading.

From the above, it will be appreciated that the floatation rings 220 and 230 can also be added to existing pontoon roofs to improve the drainage and buoyancy thereof.

Recapitulating, the improved floating roof 200 of the present invention assures positive drainage of the deck 205 by providing the sumps 226, 236 and 246 thereof due to the asymmetric distribution of the weight of the floatation rings 220 and 230 upon the deck 205. The structural load on the pontoon 210 is also reduced, the floatation rings 220 and 230 acting to support and reinforce the deck 205; in this connection, the floatation rings 220 and 230 also inhibit wind induced wave motion in the deck 205, thus to reduce the strain thereon and on the pontoon 210. In the event of a leakage due to a puncture of the deck 205, the floatation rings 220 and 230 greatly reduce the area affected by the leak, and also impart added buoyancy to the floating roof 200 to insure continued floatation thereof.

Figure 6:
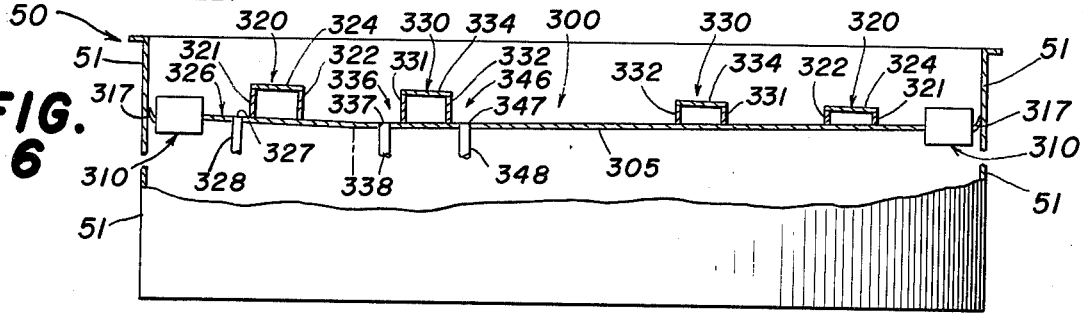
FIG. 6 is a view partially in vertical section of a storage tank like that of FIG. 1 and illustrating a third preferred embodiment of a floating roof made in accordance with and embodying the principles of the present invention.
Figure 7:
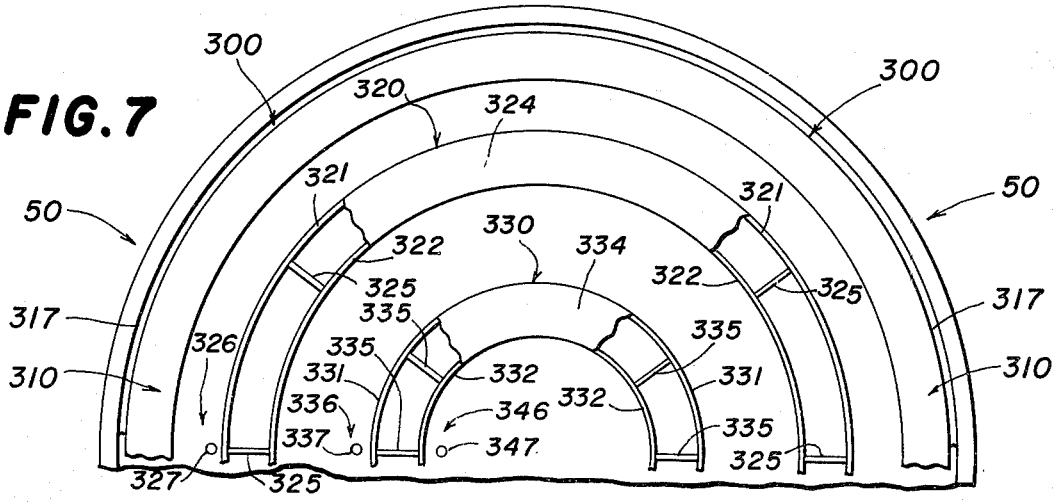
FIG. 7 is a fragmentary plan view of the floating roof of FIG. 6 with certain parts broken away.

Referring to FIGS. 6 and 7 of the drawings, there is shown a third preferred embodiment of a floating roof 300 made in accordance with and embodying the principles of the present invention. Many of the parts of the floating roof 300 are identical in construction to and function like parts in the floating roofs 100 and 200, whereby suitable numerals in the 300 series corresponding to numerals in the 100 and 200 series have been applied to the parts of the floating roof 300 that correspond to like numbered parts in the floating roofs 100 and 200. The floating roof 300 also has been shown in association with a storage tank 50 identical to that illustrated with respect to the floating roof 100.

The floating roof 300 includes a deck 305 which is a sheet of metal plate that substantially covers the surface of the liquid stored within the tank 50. Surrounding the deck 305 is a pontoon 310 which extends outwardly from the deck 305 toward the side wall 51, the space therebetween being sealed by sealing structure 317 identical to the sealing structure 117 described above. The pontoon 310 has a construction like the pontoon 110 described above with respect to the floating roof 100.

Two floatation rings 320 and 330 are provided on the deck 305, the floatation rings 320 and 330 being intermediate the center of the deck 305 and the pontoon 310, the floatation ring 320 being essentially concentric with and intermediate to the pontoon 310 and the floatation ring 330, while the floatation ring 330 is essentially concentric with the floatation ring 320.

The floatation ring 320 includes an outer side wall or rim 321 that is disposed essentially vertical with respect to deck 305, is circular in shape as viewed in FIG. 7, and is essentially concentric with the pontoon 310. An inner side wall or rim 322 is provided that also is disposed essentially vertical with respect to the deck 305, is circular in shape as viewed in FIG. 7, and is disposed essentially concentric with the outer side wall 321. The deck 305 serves as the bottom plate for the floatation ring 320, and a top plate or cover plate 324 is provided, the shape of the cover plate 324 being such as to cover the area between the side walls 321 and 322, all as is illustrated in FIG. 7. A plurality of radially extending transverse bulkhead plates 325 is provided in the floatation ring 320 at spaced points therearound to provide hermetically sealed liquid-tight compartments therein. More specifically, the deck 305, the side walls 321 and 322, the cover plate 324 and the bulkhead plates 325 are all suitably joined one to the other as required, such as by welding or the like, to provide liquid-tight seams therebetween.

The floatation ring 330 includes an outer side wall or rim 331 that is disposed essentially vertical with respect to the deck 305, is circular in shape as viewed in FIG. 7, and is essentially concentric with the pontoon 310 and the outer side wall 321 of the floatation ring 320. An inner side wall or rim 332 is provided that also is disposed essentially vertical with respect to the deck 305, is circular in shape as viewed in FIG. 7, and is essentially concentric with the pontoon 310 and the outer side wall 331. The deck 305 serves as the bottom plate for the floatation ring 330, and a top plate or cover plate 334 is provided, the shape of the cover plate 334 in plan being such as to cover the area between the side walls 331 and 332, all as is illustrated in FIG. 7. A plurality of radially extending transverse bulkhead plates 335 is provided in the floatation ring 330 at spaced points therearound to provide hermetically sealed and liquid-tight compartments. More specifically, the deck 305, the side walls 331 and 332, the cover plate 334 and the bulkhead plates 335 are all suitably joined one to the other as required, such as by welding or the like, to provide liquid-tight seams therebetween.

The side walls 321 and 322 of the floatation ring 320 and the side walls 331 and 332 of the floatation ring 330 are all essentially circular in configuration, concentric one with the other, and of uniform thickness along the entire length thereof. The side walls, however, are of varying height around the circumference thereof. The highest points of each of the side walls 321, 322, 331 and 332 being along the horizontal center line to the left in FIG. 7 and at the point of the section of FIG. 6 at the left thereof. From the highest point illustrated at the left in FIG. 6, the side walls 321, 322, 331 and 332 uniformly decrease in height to a point along the horizontal center line to the right in FIG. 7 and the point at which the section of FIG. 6 is taken, and specifically the right hand portion thereof.

As a result of this formation of the side walls, and the configuration of the side walls 321, 322, 331 and 332, the floatation rings 320 and 330 are substantially heavier on the left portions thereof as viewed in FIG. 6 than on the right portions thereof. The resultant asymmetrical distribution of weight upon the deck 305 causes the deck 305 to be deformed downwardly in the left hand portions of FIGS. 6 and 7 to provide sumps 326, 336 and 346, the sump 326 collecting all of the liquid upon the deck 305 between the pontoon 310 and the floatation ring 320, the sump 336 collecting all of the liquid upon the deck 305 within the floatation rings 320 and 330, and the sump 346 collecting all of the liquid upon the deck 305 within the floatation ring 330. Disposed in the sumps 326, 336 and 346 are drain openings 327, 337 and 347, respectively, connected with drain pipes 328, 338 and 348, respectively, that form part of a drain system to drain liquids to the exterior of the associated tank 50.

The floatation rings 320 and 330 also perform the important function of providing additional buoyancy to the deck 305 in the event of inadvertent or accidental puncture thereof. More particularly, the water-tight character of the floatation rings 320 and 330 will come into action and will support the deck 305 and all the attached structures by floatation upon the liquid lading within the associated tank 50. The provision of the bulkhead plates 325 and 335 in the floatation rings 320 and 330, respectively, also assures that there will be added buoyancy even if the puncture of the deck 305 occurs in an area covered by one of the floatation rings 320 and 330, the bulkhead plates 325 and 335 isolating and limiting the volume of the floatation rings that would be flooded by the liquid lading.

From the above, it will be appreciated that the floatation rings 320 and 330 can also be added to existing pontoon roots to improve the drainage and buoyancy thereof.

Recapitulating, the improved floating roof 300 of the present invention assures positive drainage of the deck 305 by providing the sumps 326, 336 and 346 thereon due to the asymmetric distribution of the weight of the floatation rings 320 and 330 upon the deck 305. The structural load on the pontoon 310 is also reduced, the floatation rings 320 and 330 acting to support and reinforce the deck 305; in this connection, the floatation rings 320 and 330 also inhibit wind induced wave motions in the deck 305, thus to reduce the strain thereon and on the pontoon 310. In the event of a leakage due to a puncture of the deck 305, the floatation rings 320 and 330 greatly reduce the area affected by the leak, and also impart added buoyancy to the floating roof 300 to insure continued floatation thereof.

Figure 8:
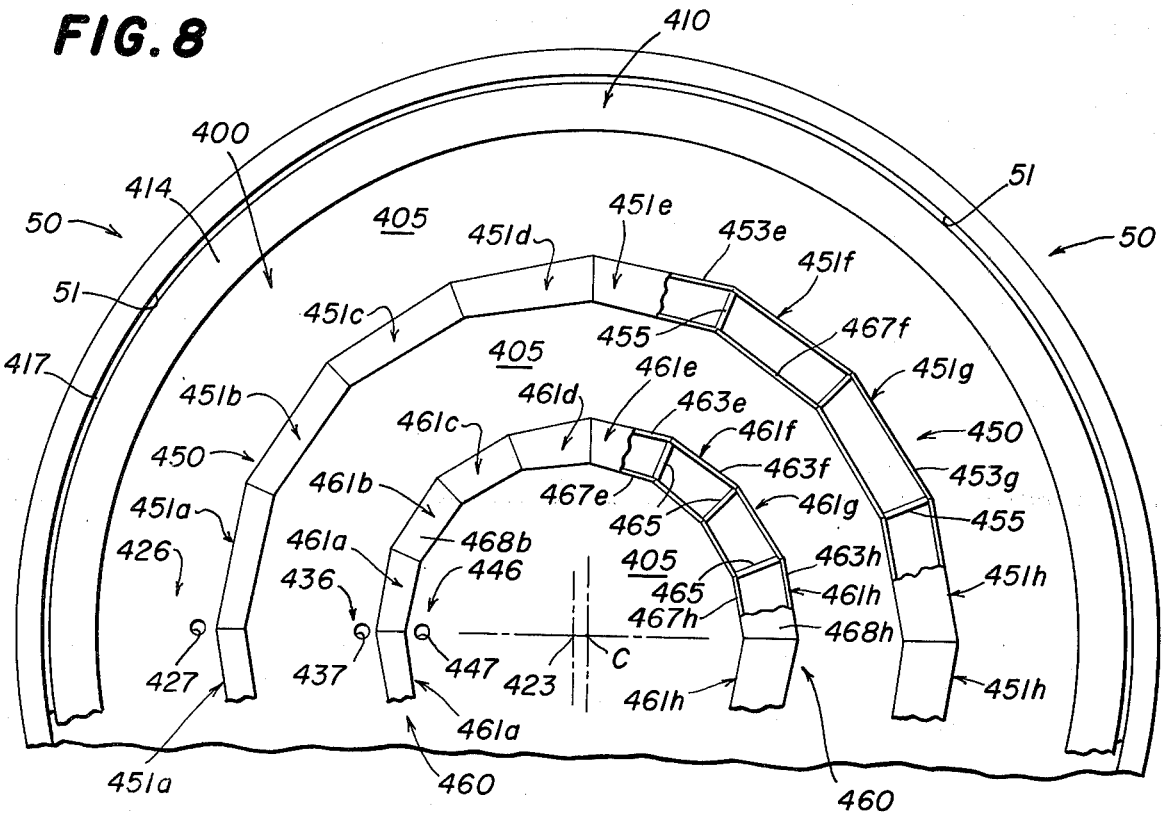
FIG. 8 is a view similar to FIG. 2 showing a further preferred embodiment of a floating roof made in accordance with and embodying the principles of the present invention, the floatation rings in FIG. 8 being formed of straight sections interconnected to provide a polygonal form of floatation ring.
Figure 9:
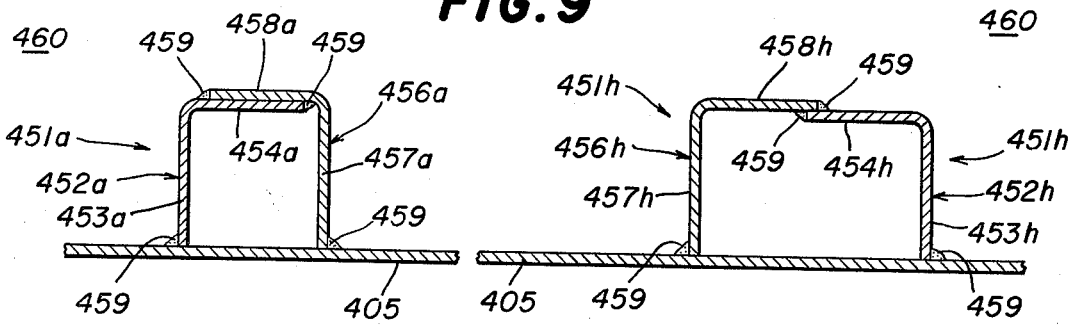
FIG. 9 is an enlarged fragmentary view in vertical section through the intermediate floatation ring of the floating roof of FIG. 8 and diagrammatically illustrating the principle of operation thereof.
Figure 10:
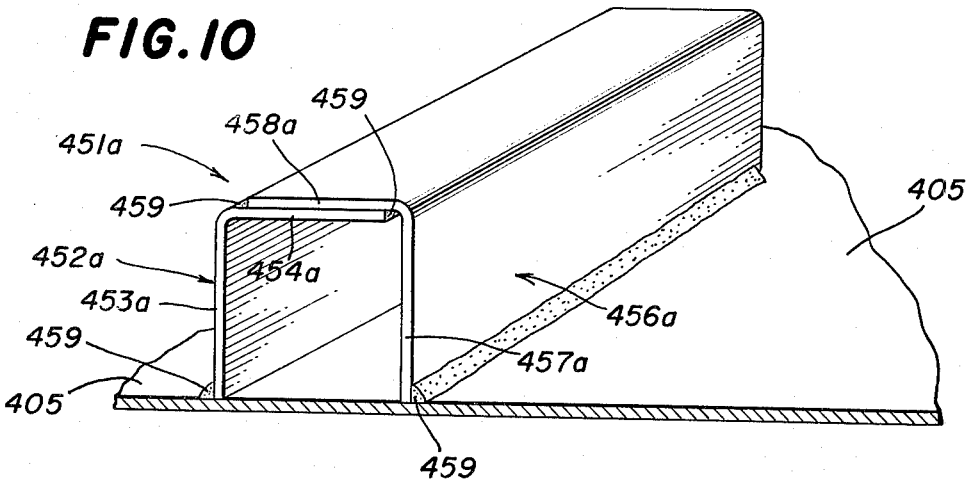
FIG. 10 is a fragmentary perspective view of one of the straight sections of one of the floatation rings of FIG. 8.

Referring to FIGS. 8 to 10 of the drawings, there is shown a fourth preferred embodiment of a floating roof 400 made in accordance with and embodying the principles of the present invention. Many of the parts of the floating roof 400 are identical in construction to and function like parts in the floating roofs 100, 200 and 300, whereby suitable numerals in the 400 series corresponding to like numerals in the 100, 200 and 300 series have been applied to the parts of the floating roof 400 that correspond to like parts in the floating roofs 100, 200 and 300. The floating roof 400 also has been shown in association with a storage tank 50 identical in construction and operation to that illustrated with respect to the floating roof 100.

The floating roof 400 includes a deck 405 which is a sheet of steel plate that essentially covers the surface of the liquid stored within the tank 50. Surrounding the deck 405 is a pontoon 410 that extends outwardly from the deck 405 and toward the side wall 51, the space therebetween being sealed by sealing structure 417 identical to the sealing structure 117 described above. The pontoon 410 has a construction like the pontoon 110 described with respect to the floating roof 100.

Floatation rings 450 and 460 are disposed intermediate the center of the deck 405 designated by the letter C, and the pontoon 410. The intermediate floatation ring 450 is essentially concentric with and intermediate the pontoon 410 and the inner floatation ring 460, while the inner floatation ring 460 is essentially concentric with the intermediate floatation ring 450.

The floatation ring 450 is formed of a plurality of rectilinear sections 451*a* through 451*h* arranged to form a closed polygonal configuration. Referring to FIGS. 9 and 10, the details of construction of one of the rectilinear sections, specifically rectilinear section 451*a*, is illustrated. An outer angle member 452*a* is provided including a vertically extending portion providing an outer side wall 453*a* and having an integral top flange 454*a* extending inwardly toward the center of the deck 405. An inner angle member 456*a* is provided having a vertically arranged portion providing an inner side wall 457*a* disposed substantially vertically with respect to the deck 405. Integral with the upper edge of inner side wall 457*a* is a top flange 458*a* directed outwardly away from the center C and closely overlying the top flange 454*a* on the outer angle member 452*a*. As is best seen in FIG. 9, the side walls 453*a* and 457*a* are disposed parallel to each other and both normal to the deck 405 and are secured to the deck 405 by welds 459. The outer ends of the top flanges 454*a* and 458*a* are secured to each other by welds 459.

The various rectilinear sections 451*b* through 451*h* are of essentially the same construction as the section 451*a* described above, but are of increasing widths, the section 451*h* being illustrated to the right in FIG. 9 and being the widest section in the intermediate floatation ring 450. The outer angle members 452*a* through 452*h* are identical in construction one to the other, and the inner angle members 456*a* through 456*h* are identical in construction one to the other, and furthermore, as illustrated, are identical in construction to the outer angle members 452*a* through 452*h*. The different widths of the sections 451*a* through 451*h* is achieved by spacing the outer angle members 452*a* through 452*h* different and increasing distances from the corresponding cooperating inner angle members 456*a* through 456*h*, respectively. The outer side walls 453*a* through 453*h* form a polygonal closed surface which is essentially concentric with the center C of the pontoon 410, while the inner side walls 457*a* through 457*h* form a closed polygonal figure that is disposed eccentrically with respect to the other side wall 452, the center of the inner polygonal wall being shifted to the left to the point 423 with respect to the center C of the pontoon 410 and the outer side wall 452. It will be appreciated that the deck 405 serves as the bottom plate for the floatation ring 450. A plurality of transverse radially extending bulkhead plates 455 is provided at the junctures of the several sections 451 to provide hermetically sealed liquid-tight compartments. More specifically, the deck 405, the outer angle members 452, the inner angle members 453 and the bulkhead plates 455 are all suitably joined one to the other as required, as illustrated with the welds 459, to provide liquid-tight seams therebetween.

The floatation ring 460 is formed of a plurality of rectilinear sections 461*a* through 461*h* arranged to form a closed polygonal configuration, these sections being essentially constructed like sections 451*a* through 451*h*. The various rectilinear sections 461*a* through 461*h* are of essentially the same construction but are of increasing widths, the section 461*h* being the widest section in the floatation ring 460. The outer side walls 463*a* through 463*h* form a polygonal closed surface which is essentially concentric with the center C of the pontoon 410, while the inner side walls 467*a* through 467*h* form a closed polygonal figure that is disposed eccentrically with respect to the outer side wall 462, the center of the inner polygonal wall being shifted to the left to the point 423 with respect to the center C of the pontoon 410 and the outer side wall 462. It will be appreciated that the deck 405 serves as the bottom plate for the floatation ring 460. A plurality of transverse radially extending bulkhead plates 465 is provided at the junctures of the several sections 461 to provide hermetically sealed liquidtight compartments. More specifically, the deck 405, the outer angle members 462, the inner angle members 463 and all bulkhead plates 465 are all suitably joined one to the other as required such as by welding, to provide liquid-tight seams therebetween.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A floating roof for covering liquids stored in storage tanks or the like wherein the roof floats on the stored liquid, said roof including a deck generally conforming to the horizontal cross-sectional shape of the associated storage tank and having transverse dimensions and a thickness such as to cause said deck to be flexible, a pontoon around the outer periphery of said deck and secured thereto for imparting buoyancy to said roof to float said roof upon the surface of the stored liquid, said deck having an upper surface and a lower surface in contact with the stored liquid to prevent evaporation therefrom and to prevent contamination thereof, and a hermetically sealed hollow floatation ring mounted on said deck and secured thereto and disposed intermediate the center and the outer edge thereof, the weight of said floatation ring being asymmetrically disposed with respect to said deck so as to place an area of said deck at a lower level than all other areas of said deck to provide a sump thereon, and a drain communicating with said sump to drain liquid from the upper surface of said deck to maintain the buoyancy of said roof at all times.

2. The floating roof set forth in claim 1, wherein a sump is provided for the area between said pontoon and said floatation ring and for the area within said floatation ring, said drain communicating with both said sumps.

3. The floating roof set forth in claim 1, wherein said floatation ring has a plurality of bulkheads therein dividing the floatation ring into a plurality of liquid-tight compartments.

4. The floating roof set forth in claim 1, wherein at least two generally concentrically arranged floatation rings are mounted on said deck.

5. A floating roof for covering liquids stored in storage tanks or the like wherein the roof floats on the stored liquid, said roof including a deck generally conforming to the horizontal cross-sectional shape of the associated storage tank and having transverse dimensions and a thickness such as to cause said deck to be flexible, a pontoon around the outer periphery of said deck and secured thereto for imparting buoyancy to said roof to float said roof upon the surface of the stored liquid, said deck having an upper surface and a lower surface in contact with the stored liquid to prevent evaporation therefrom and to prevent contamination thereof, and a hermetically sealed hollow floatation ring mounted on said deck and secured thereto and disposed intermediate the center and the outer edge thereof, said floatation ring including a pair of spaced-apart side walls extending upwardly from said deck a predetermined uniform height and a cover plate having a generally uniform thickness covering the area between said side walls, said side walls having generally uniform thicknesses around said floatation ring and being spaced closest to each other at one point therearound and being spaced furthest apart from each other at another point therearound disposed from said one point, thereby to provide greater weight per unit area of said floatation ring at the one point to place the corresponding area of said deck at a lower level than all other areas of said deck to provide a sump thereon, and a drain communicating with said sump to drain liquid from the upper surface of said deck to maintain the buoyancy of said roof at all times.

6. The floating roof set forth in claim 1, wherein said floatation ring has a plurality of bulkheads therein dividing the floatation ring into a plurality of liquid-tight compartments.

7. The floating roof set forth in claim 5, wherein at least two generally concentrically arranged floatation rings are mounted on said deck.

8. A floating roof for covering liquids stored in storage tanks or the like wherein the roof floats on the stored liquid, said roof including a deck generally conforming to the horizontal cross-sectional shape of the associated storage tank and having transverse dimensions and a thickness such as to cause said deck to be flexible, a pontoon around the outer periphery of said deck and secured thereto for imparting buoyancy to said roof to float said roof upon the surface of the stored liquid, said deck having an upper surface and a lower surface in contact with the stored liquid to prevent evaporation therefrom and to prevent contamination thereof, and a hermetically sealed hollow floatation ring mounted on said deck and secured thereto and disposed intermediate the center and the outer edge thereof, said floatation ring including a pair of spaced-apart side walls extending upwardly from said deck a predetermined generally uniform height and a cover plate having a generally uniform thickness covering the area between said side walls, said side walls being substantially uniformly spaced apart around said floatation ring and being of greatest thickness at one point thereacross and decreasing in thickness to a minimum thickness and at another point therearound disposed from said one point, thereby to provide greater weight per unit area of said floatation ring at the one point to place the corresponding area of said deck at a lower level than all other areas of said deck to provide a sump thereon, and a drain communicating with said sump to drain liquid from the upper surface of said deck to maintain the buoyancy of said roof at all times.

9. The floating roof set forth in claim 8, wherein said floatation ring has a plurality of bulkheads therein dividing the floatation ring into a plurality of liquid-tight compartments.

10. The floating roof set forth in claim 8, wherein at least two generally concentrically arranged floatation rings are mounted on said deck.

11. A floating roof for covering liquids stored in storage tanks or the like wherein the roof floats on the stored liquid, said roof including a deck generally conforming to the horizontal cross-sectional shape of the associated storage tank and having transverse dimensions and a thickness such as to cause said deck to be flexible, a pontoon around the outer periphery of said deck and secured thereto for imparting buoyancy to said roof to float said roof upon the surface of the stored liquid, said deck having an upper surface and a lower surface in contact with the stored liquid to prevent evaporation therefrom and to prevent contamination thereof, and a hermetically sealed hollow floatation ring mounted on said deck and secured thereto and disposed intermediate the center and the outer edge thereof, said floatation ring including a pair of spaced-apart side walls of generally uniform thickness extending upwardly from said deck and a cover plate having a generally uniform thickness covering the area between said side walls, said side walls being of greatest height at one point therearound and decreasing in height to a minimum height at another point therearound disposed from said one point, thereby to provide greater weight per unit area of said floatation ring at the one point to place a corresponding area of said deck at a lower level than all other areas of said deck to provide a sump thereon, and a drain communicating with said sump to drain liquid from the upper surface of said deck to maintain the buoyancy of said roof at all times.

12. The floating roof set forth in claim 11, wherein said floatation ring has a plurality of bulkheads therein dividing the floatation ring into a plurality of liquid-tight compartments.

13. The floating roof set forth in claim 11, wherein at least two generally concentrically arranged floatation rings are mounted on said deck.

14. A floating roof for covering liquids stored in storage tanks or the like wherein the roof floats on the stored liquid, said roof including a deck generally conforming to the horizontal cross-sectional shape of the associated storage tank and having transverse dimensions and a thickness such as to cause said deck to be flexible, a pontoon around the outer periphery of said deck and secured thereto for imparting buoyancy to said roof to float said roof upon the surface of the stored liquid, said deck having an upper surface and a lower surface in contact with the stored liquid to prevent evaporation therefrom and to prevent contamination thereof, and a hermetically sealed hollow floatation ring mounted on said deck and secured thereto and disposed intermediate the center and the outer edge thereof, said floatation ring including a plurality of rectilinear sections interconnected to form a polygonal ring, each rectilinear section having a pair of spaced-apart straight side walls extending upwardly from said deck a predetermined uniform height and a cover plate having a generally uniform thickness covering the area between said side walls, said side walls having generally uniform thicknesses around said floatation ring and being spaced closest to each other at one point therearound and being spaced farthest apart from each other at another point therearound disposed from said one point, thereby to provide greater weight per unit area of said floatation ring at the one point to place the corresponding area of said deck at a lower level than all other areas of said deck to provide a sump thereon, and a drain communicating with said sump to drain liquid from the upper surface of said deck to maintain the buoyancy of said roof at all times.

15. The floating roof set forth in claim 14, wherein said polygonal floatation ring has a plurality of bulkheads therein at the junctures of said rectilinear sections dividing the polygonal floatation ring into a plurality of liquid-tight compartments.

16. The floating roof set forth in claim 14, wherein at least one generally concentrically arranged polygonal floatation rings are mounted on said deck.

17. The floating roof set forth in claim 14, wherein each rectilinear section is formed of opposed angle members each including one of said straight side walls and a top flange overlapping the top flange of the other angle member to provide said cover plate, opposed pairs of said angle members being spaced apart different distances around said floatation ring.

* * * * *

UNITED STATES PATENT OFFICE

CERTIFICATE OF CORRECTION

PATENT NO. : 3,944,113

DATED : March 16, 1976

INVENTOR(S) : Milton W. Heisterberg

It is certified that error appears in the above-identified patent and that said Letters Patent are hereby corrected as shown below:

Column 4, line 62, "essentially" should be --eccentrically--.
Column 7, line 44, after "provided" insert --in the floatation ring 230 at spaced points therearound to provide--.
Column 10, line 40, "roots" should be --roofs--.
Column 13, line 27, "furthest" should be --farthest--;
line 36, "1" should be --5--;
line 65, "thereacross" should be --therearound--.
Column 16, line 7, "one" should be --two--.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*